US006058814A

United States Patent [19]

Johnson

[11] Patent Number: 6,058,814

[45] Date of Patent: May 9, 2000

[54] EXTENDABLE TOOL

[76] Inventor: Russell Johnson, 141 Storm Dr., Holtsville, LI, N.Y. 11742

[21] Appl. No.: 09/003,038

[22] Filed: Jan. 5, 1998

[51] Int. Cl.[7] ..... B25B 23/16

[52] U.S. Cl. ..... 81/177.2; 81/177.85

[58] Field of Search ..... 81/177.2, 438, 81/177.85, 177.1, 62

[56] References Cited

U.S. PATENT DOCUMENTS

| | | | |
|---|---|---|---|
| 1,370,820 | 3/1921 | Johnson | 81/177.2 |
| 2,682,414 | 6/1954 | Richarson | 81/438 |
| 4,376,397 | 3/1983 | Newby et al. | 81/177.2 |
| 4,409,866 | 10/1983 | McBride | 81/177.2 |
| 4,729,281 | 3/1988 | Holloway, Jr. | 81/177.2 |
| 4,762,032 | 8/1988 | Chow | 81/62 |
| 4,905,548 | 3/1990 | Colace et al. | 81/177.2 |
| 5,392,673 | 2/1995 | Scott | 81/177.2 |
| 5,396,820 | 3/1995 | Baker | 81/177.2 |
| 5,477,758 | 12/1995 | Cunningham | 81/177.85 |
| 5,749,271 | 5/1998 | Liu | 81/63 |

FOREIGN PATENT DOCUMENTS

| | | | |
|---|---|---|---|
| 1147176 | 5/1983 | Canada | 81/177.2 |

*Primary Examiner*—David A. Scherbel
*Assistant Examiner*—Joni B. Danganan
*Attorney, Agent, or Firm*—Michael I Kroll

[57] ABSTRACT

An extendable tool (10) comprising a handle (12) to be grasped by a hand of a person. A shank (14) is in alignment with the handle (12). The shank (14) has an operable head (16) on a distal end. A structure (18) is for extending the handle (12) lengthwise with respect to the shank (14). An assembly (20) is for retaining the handle (12) in position lengthwise with respect to the shank (14), so that the handle (12) can be lengthened for leverage purposes and shortened to fit into compact work areas and for storage when not in use.

1 Claim, 2 Drawing Sheets

EXTENDABLE TOOL

BACKGROUND OF THE INVENTION

1. Field of the Invention

The instant invention relates generally to hand tools and more specifically it relates to an extendable tool. The extendable tool contains a handle which can be lengthened for leverage purposes and shortened, so that it can fit into compact work areas and take up less room when placed in storage when not in use.

2. Description of the Prior Art

Numerous hand tools have been provided in the prior art that are adapted to have handles which are of a fixed length and cannot be extended. While these units may be suitable for the particular purpose to which they address, they would not be as suitable for the purposes of the present invention as heretofore described.

SUMMARY OF THE INVENTION

A primary object of the present invention is to provide an extendable tool that will overcome the shortcomings of the prior art devices.

Another object is to provide an extendable tool in which its handle can be lengthened for leverage purposes and shortened to fit into compact work areas and for storage when not in use.

An additional object is to provide an extendable tool that can be incorporated into all types of hand held tools, such as wrenches, pliers, adjustable wrenches, pipe wrenches, screwdrivers and other tools that have a handle.

A further object is to provide an extendable tool that is simple and easy to use.

A still further object is to provide an extendable tool that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
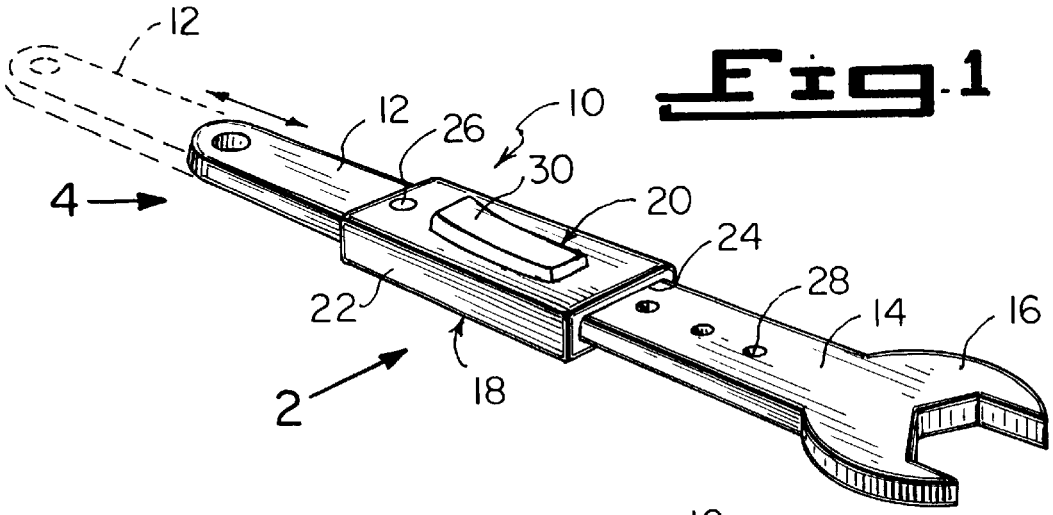
FIG. 1 is a front perspective view of a first embodiment of the instant invention.
Figure 2:
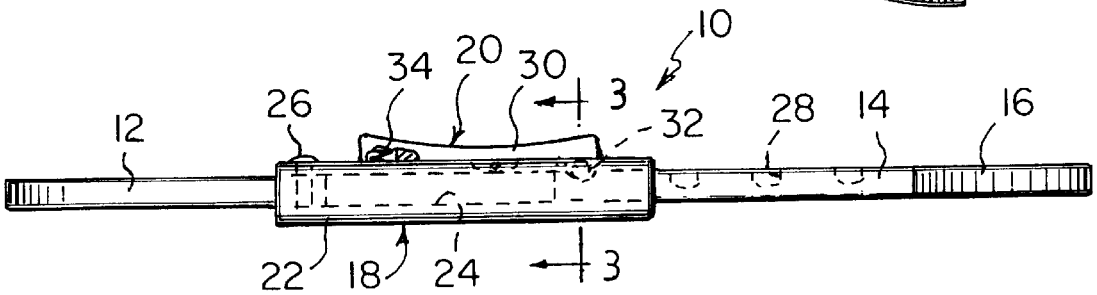
FIG. 2 is a side view taken in the direction of arrow 2 in FIG. 1.
Figure 3:
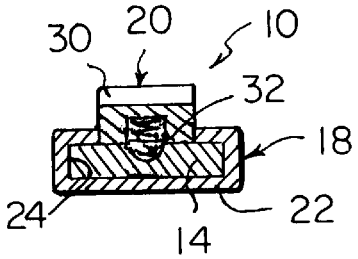
FIG. 3 is a cross sectional view taken along line 3—3 in FIG. 2.
Figure 4:
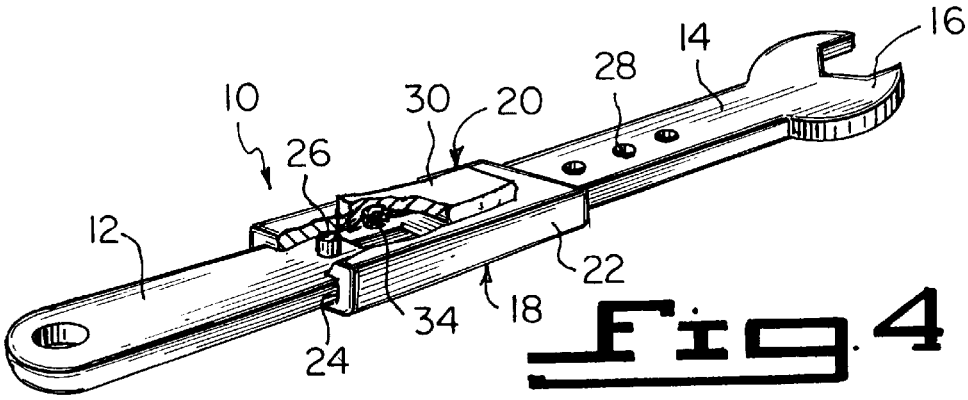
FIG. 4 is a rear perspective view taken in the direction of arrow 4 in FIG. 1, with parts broken away and in section.

Turning now descriptively to the drawings, in which similar reference characters denote similar elements throughout several views, FIGS. 1 through 7 illustrate the present invention being an extendable tool 10.

The extendable tool 10 comprises a handle 12 to be grasped by a hand of a person. A shank 14 is in alignment with the handle 12. The shank 14 has an operable head 16 on a distal end. A structure 18 is for extending the handle 12 lengthwise with respect to the shank 14. An assembly 20 is for retaining the handle 12 in position lengthwise with respect to the shank 14, so that the handle 12 can be lengthened for leverage purposes and shortened to fit into compact work areas and for storage when not in use.

The extending structure 18, shown in FIGS. 1 through 4, consists of a sleeve 22 having a longitudinal aperture 24 therethrough. A rivet 26 affixes one end of the sleeve 22 to the handle 12, so that the shank 14 can slide within the longitudinal aperture 24 in the sleeve 22 for lengthwise adjustment.

The retaining assembly 20 includes the shank 14 having a plurality of longitudinal spaced apart recesses 28 therealong. A rocker button 30 is pivotally mounted into and through the sleeve 22. A spring biased projection 32 is on an inner side of the rocker button 30 at a first end, to engage with any one of the recesses 28 in the shank 14. A return spring 34 is on the inner side of the rocker button 30 at a second end. The spring biased projection 32 will normally engage with any one of the recesses 28 in the shank 14, until the rocker button 30 is manually depressed to overcome the return spring 34 and release the spring biased projection 32 therefrom. The shank 14 and the sleeve 22 are rectangular shaped to prevent rotational movement between the shank 14 and the sleeve 22, while allowing lengthwise adjustment between the shank 14 and the sleeve 22.

Figure 5:
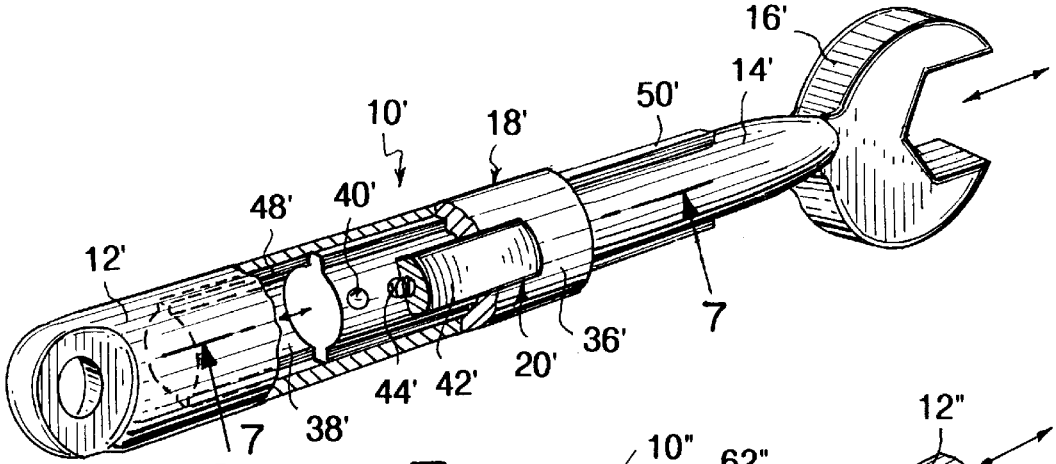
FIG. 5 is a rear perspective view of a second embodiment with parts broken away and in section.
Figure 7:
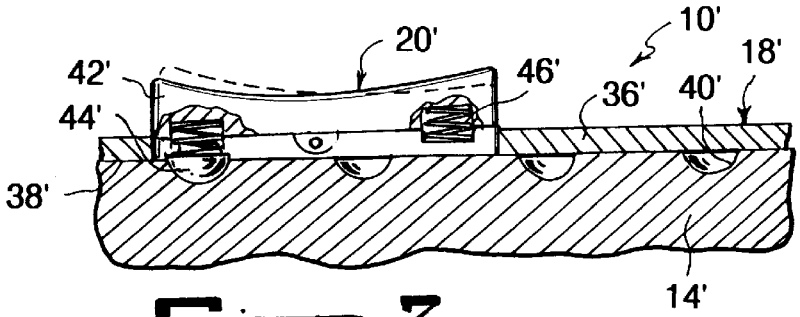
FIG. 7 is an enlarged cross sectional view taken along line 7—7 in FIG. 5.

The extending structure 18 in FIGS. 5 and 7, includes a sleeve 36' integral with the handle 12' and having a longitudinal aperture 38' therein. The shank 14' can slide within the longitudinal aperture 38' in the sleeve 36' for lengthwise adjustment.

The retaining assembly 20' includes the shank 14' having a plurality of longitudinal spaced apart recesses 40' therealong. A rocker button 42' is pivotally mounted into and through the sleeve 36'. A spring biased projection 44' is on an inner side of the rocker button 42' at a first end, to engage with any one of the recesses 40' in the shank 14'. A return spring 46' is on the inner side of the rocker button 42' at a second end. The spring biased projection 44' will normally engage with any one of the recesses 40' in the shank 14', until the rocker button 42' is manually depressed to overcome the return spring 46' and release the spring biased projection 44' therefrom.

The shank 14' and the sleeve 36 are cylindrical shaped. The longitudinal aperture 38' in the sleeve has at least one longitudinal groove 48 therealong. The shank 14 has at least one longitudinal tongue 50' therealong which rides within the at least one longitudinal groove 48', so as to prevent rotational movement between the shank 14 and the sleeve 36', while allowing lengthwise adjustment between the shank 14 and the sleeve 36'.

Figure 6:
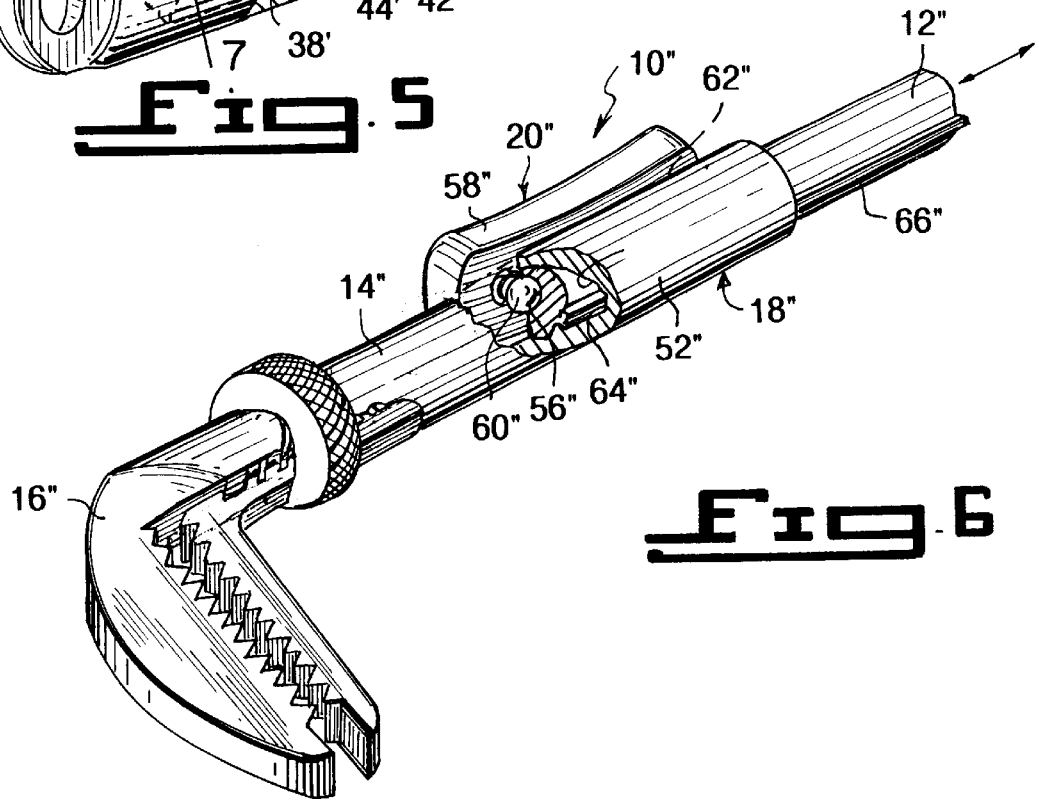
FIG. 6 is a front perspective view of a third embodiment with parts broken away and in section.

The extending structure 18" in FIG. 6, includes a sleeve 52" integral with the shank 14" and having a longitudinal aperture 54" therein. The handle 12" can slide within the longitudinal aperture 54" in the sleeve 52" for lengthwise adjustment.

The retaining assembly 20" consists of the handle 12" having a plurality of longitudinal spaced apart recesses 56" therealong. A rocker button 58 is pivotally mounted into and through the sleeve 52". A spring biased projection 60" is on an inner side of the rocker button 58" at a first end, to engage with any one of the recesses 56" in the handle 12". A return spring (not shown) is on the inner side of the rocker button 58" at a second end. The spring biased projection 60" will normally engage with any one of the recesses 56" in the handle 12", until the rocker button 58" is manually depressed to overcome the return spring and release the spring biased projection 60" therefrom.

The handle 12" and the sleeve 52" are cylindrical shaped. The longitudinal aperture 54" in the sleeve 52" has at least one longitudinal groove 64" therealong. The handle 12" has at least one longitudinal tongue 66" therealong, which rides within the at least one longitudinal groove 64", so as to prevent rotational movement between the handle 12" and the sleeve 52", while allowing lengthwise adjustment between the handle 12" and the sleeve 52".

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An extendable tool comprising:

a) a handle to be grasped by a hand of a person;

b) a shank in alignment with said handle, said shank having an operable head on a distal end;

c) means for extending said handle lengthwise with respect to said shank comprising a sleeve having a longitudinal aperture therethrough and means to affix one end of said sleeve to said handle so that said shank can slide within said longitudinal aperture in said sleeve for lengthwise adjustment;

d) means for retaining said handle in position lengthwise with respect to said shank comprising a plurality of longitudinal spaced apart recesses along the length of said shank, a rocker button with a longitudinally extended concave upper surface pivotally mounted into and through said sleeve, a projection biased by a first spring on an inner side of said rocker button at a first end to engage with any one of said recesses in said shank, and a second, return spring on the inner side of said rocker button at a second end so that said spring biased projection will normally engage with any one of said recesses in said shank until said rocker button is manually depressed to overcome said return spring and release said spring biased projection therefrom, so that said handle can be lengthened for leverage purposes and shortened to fit into compact work areas and for storage when not in use; and e) said shank and said sleeve both being cylindrically shaped, said longitudinal aperture in said sleeve having at least one longitudinal groove therealong, and said shank having at least one longitudinal tongue therealong which rides within said longitudinal groove, to prevent rotational movement between said shank and said sleeve, while allowing lengthwise adjustment between said shank and said sleeve.

* * * * *